United States Patent [19]

Meirovitz

[11] 4,241,923

[45] Dec. 30, 1980

[54] BOARD GAME

[75] Inventor: Mordecai Meirovitz, Haifa, Israel

[73] Assignee: Invicta Plastics Limited, Great Britain

[21] Appl. No.: 2,366

[22] Filed: Jan. 10, 1979

[30] Foreign Application Priority Data

Jan. 14, 1978 [GB] United Kingdom ..... 01559/78

[51] Int. Cl.[3] ..... A63F 3/00

[52] U.S. Cl. ..... 273/265; 273/283

[58] Field of Search ..... 273/265, 272, 283, 284, 273/157 R, 271, 269, 287; 35/27, 31 G, 35 A, 60; 46/16, 24, 25, 31

[56] References Cited

U.S. PATENT DOCUMENTS

| | | | |
|---|---|---|---|
| 2,115,962 | 5/1938 | Orme | 46/24 X |
| 2,497,341 | 2/1950 | Bisson | 273/287 |
| 3,374,558 | 3/1968 | Smith | 273/284 X |
| 3,514,110 | 5/1970 | Thomander | 273/265 |
| 3,748,752 | 7/1973 | Quercetti | 35/27 |
| 4,059,274 | 11/1977 | Samson | 273/265 |

FOREIGN PATENT DOCUMENTS

| | | | |
|---|---|---|---|
| 1009675 | 5/1977 | Canada | 273/265 |
| 899926 | 9/1944 | France | 273/265 |
| 167194 | 4/1934 | Switzerland | 35/70 |

OTHER PUBLICATIONS

Master Mind Championships, Feb. 1976, Games & Puzzles, pp. 10, 11.

And Now, Master Mind, p. 73, Time Magazine, Dec. 1, 1975.

*Primary Examiner*—Harland S. Skogquist

*Attorney, Agent, or Firm*—Charles E. Brown

[57] ABSTRACT

This relates to a game which includes a game board and a plurality of playing pieces. The game board is generally rectangular in outline but is provided at one end with a projection which is intended to interlock with another game board. The projection defines at least in part a receptacle for game pieces. The game board at the end thereof remote from the projection has a reserved area for receiving a selected code playing piece of a set of target code playing pieces and a code playing piece of a set of position indicating code playing pieces. The playing pieces also include test playing pieces conforming to the target code playing pieces and marker elements for signalling the correctness in relation to the code playing pieces mounted on a related one of the boards of the characteristics and relative positioning of the test playing pieces of a test group selected by a player.

9 Claims, 3 Drawing Figures

BOARD GAME

The subject of this invention is a game calling for the exercise of logical thinking and inductive reasoning on the part of the players. It is a board game in the sense that, in essence, it uses a board or boards, playing pieces, and tokens.

In concept it can be played by upwards of two players though in a preferred form, to which the ensuing description will hereinafter be confined to avoid prolixity of language it is designed for the active participation of four players.

Accordingly the present invention provides a board game comprising a plurality of boards, one for each player, a collection of contrastingly marked code pieces, a collection of marker elements, and code counters marked and/or colored and used to set up a hidden code, and wherein each said board has rows of holes for receiving and displaying a plurality of rows of said code pieces of each player, holes adjacent said rows for receiving marker elements, and holes to receive code counters representing a respective portion of said hidden code.

The underlying principle of the game is that each of the players in turn seeks to break a secret code made up of a number of contrasting ciphers arranged in a singular order. This in itself is not an original idea but what is a particularly unique feature of this invention is that the target code is not prearranged but is a combination of integers or pieces arbitrarily made up by all the participants during the playing of a game. An attempt to break the code is made by each player in turn by displaying a prospective answer and this is marked by the others (from their individual partial knowledge based on their holding of one piece of the code) until any one player is able from his observation, reasoning and surmise to announce the true hidden code and win the game.

The phrase "a plurality of boards" refers not only to the provision of an individual separate board for each player (this being convenient for the placing of the players around the particular table which is available) but also to the case where these individual boards are integral or even, as in the particular case described below, made separate but interfitting for convenient common observation.

The code pieces referred to can take various forms, but in a convenient and preferred arrangement will be in the form of pegs and the board will have rows of holes to receive them in the playing of the game. One of these rows will be separate from the others for a potential announcement by the player concerned of his surmised "discovery" of the hidden code.

Similarly the marker elements can be pins or pegs and the board furnished with holes to locate them adjacent the code holes.

Figure 1:
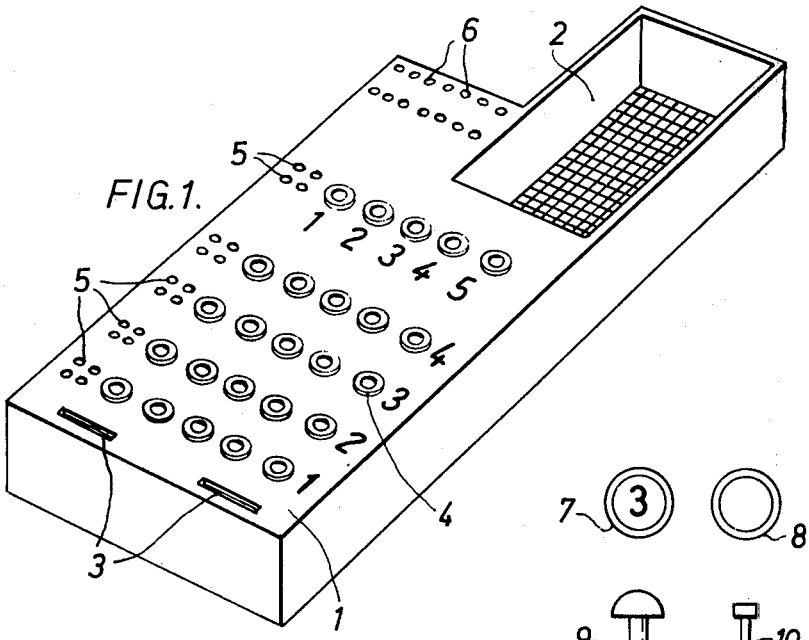
Figure 2:
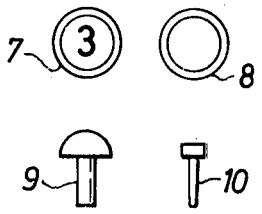
Figure 3:
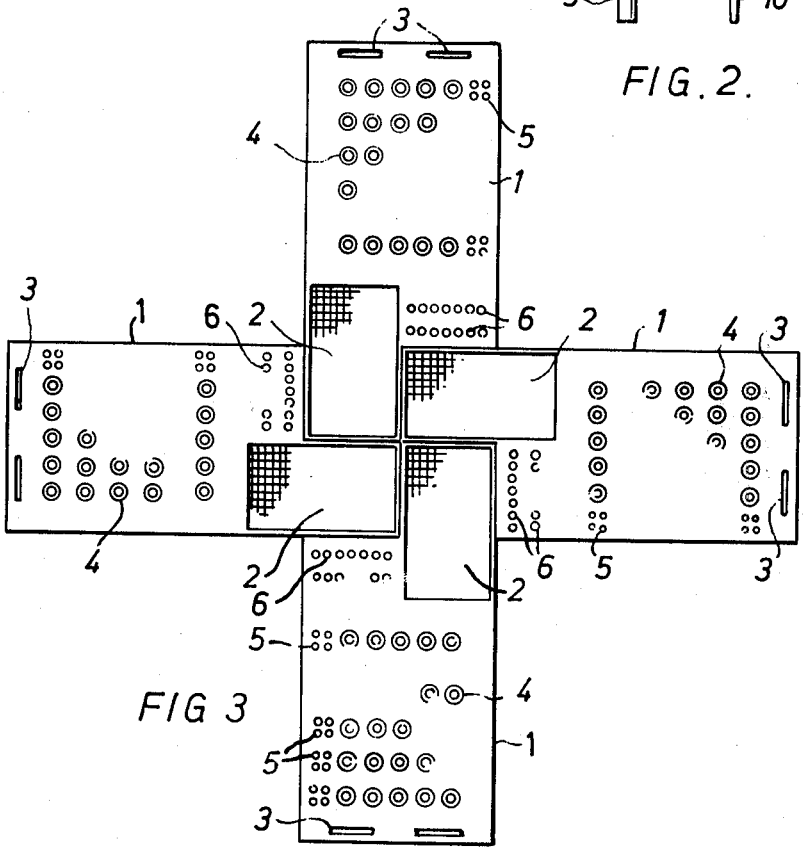

The present invention is further described hereinafter, by way of example, with reference to the accompanying drawings, in which:

FIG. 1 is a perspective illustration of an individual board used in this game, FIG. 2 shows details of the code pieces and marker elements used, and FIG. 3 is a schematic plan view of the boards interfitted as they may conveniently be in the playing of a game.

The board illustrated in FIG. 1 will conveniently be made as a hollow plastic molding. The board 1 is rectangular in shape with the addition at one end of a projection 2 which is recessed to form a tray for housing playing pieces used in the game.

The surface of the board 1 is apertured to provide holes for receiving the playing pieces, marker elements and so on. At its lower end it is provided with slots 3 to accommodate counters which will be used in the playing of the game, as described below.

Above these slots 3 are a set of horizontal holes 4 for receiving the playing pieces or pegs in code rows during the game. It will be observed that there are five holes 4 in each row. These rows are numbered 1-2-3-4 at the righthand margin adjacent the respective rows.

At the lefthand end of each row is a set of four smaller marker holes 5 the function of which will later appear. Finally at the upper lefthand corner of the board there are some two rows of five small holes 6 for storage of marker pins.

FIG. 2 gives examples of the pegs, pins and counters which are used. Thus there are black circular counters 7 which are numbered 1-2-3-4-5 on one face and counters 8 which are white on their rear face but carry different colors on their front face. In the practical example chosen use is made in fact of twenty-four counters 8, three carrying each of six different colors other than black and white.

FIG. 2 shows at 9 an example of a code peg. In the particular example chosen there are one hundred and forty four of these code pegs in a playing set these being made up of equal numbers of the six colors which are used on the counters 8. Finally, FIG. 2 shows marker pins 10 of which there are sixty in the set, thirty having black heads and thirty white heads.

The rules for playing a game with this equipment will be hereinafter described, but before so doing reference will be made to FIG. 3 which illustrates a preferred arrangement of the four boards as they can be conveniently used by the players of the game. It will be noted that the boards are conveniently disposed on the table in a position for common observation (which is required to enable the game to be followed in the manner of a card game) by the various players. Thus in effect the projections 2 of the four boards are interfitted with the bodies of the boards arranged in a cruciform fashion in the center of the table.

The rules of the game to be played with this equipment are as follows:

RULES

This game is primarily designed for four players who will receive one of the four boards of the set. The boards placed in front of the players can be interfitted at their "tray" projections if convenient. (This is the best arrangement because it makes overall inspection easier).

Each player will fill his tray with six pegs of each of the six colors available in the general collection and will take five white and five black marker pins and insert them in the storage holes in the upper lefthand corner of his board.

In playing a game the first player is chosen by any convenient random-selection method, for example by tossing coins. The black and white counters are placed face downwards on a convenient area of the table away from the boards, are shuffled, and each player in turn takes one white and one black counter which he places in the front slots of his board out of view of the other players. The counters identify his particular piece of the code, i.e. the color of the piece (peg) and its position in the code row.

The first player then starts the game by inserting code pegs from his tray into the row of code holes nearest him (marked 1 on the righthand edge of the board) to indicate his first guess at the "hidden" code. This hidden code is in fact made up by a combination of the parts held by the other players and himself plus the blank represented by the column number left unchosen at the beginning of the game.

The player on his left, the "second" player then inspects this first guess at the hidden code and compares it with his own holding of part of the code. If the first player's guess has correctly identified the part of the code held by the second player, the latter must place a black marker pin in the marker holes adjacent the first player's No: 1 code row. If the second player finds that the first player has chosen his (the second player's) color but not the correct position of this color, then he will insert a white marker in the first player's set of marking holes. If he finds that the first player has not chosen the second player's color at all, he will not insert any marker but will so certify and play will pass to the third player.

The play will continue clockwise round the table in this way, continuing into row 2 etc., until any player, whether his turn to play or otherwise, perceives or thinks he perceives the true hidden code. This he announces by shouting "Mastermind" (RTM) and play will then be suspended. The party concerned will then display his solution in the separate row of code holes marked 1-2-3-4-5 at the upper part of his board. If this is not disputed by any of the other players then he will be declared the winner.

If disputed by any one other player the game must be discontinued. If disputed by more than one other player the game may continue with the claimant disqualified but remaining present to represent his piece of the hidden code.

I claim:

1. A game comprising:

a plurality of code playing pieces of contrasted characteristics for forming a target code and comprising a first set of code playing pieces and a second set of said code playing pieces;

a plurality of boards, one for each player, each of said boards having a reserved area for receiving a pair of said code playing pieces chosen by a respective player and comprising one each of said first set of code playing pieces and said second set of code playing pieces, wherein said chosen code playing piece of said first set by each of several players together form said target code and each said chosen code playing piece of said second set determines the relative position in said target code of the code playing piece paired therewith;

a plurality of test playing pieces conforming to said first set of code playing pieces and adapted to be mounted in preselectable patterns on each of said boards in successive groups for simulating said target code;

and a plurality of marker elements each of which is mountable on any one of said boards for signalling the correctness in relation to the code playing pieces mounted on the selected one of said boards of the characteristics and relative positioning of the test playing pieces of a test group selected by a player.

2. A game as claimed in claim 1 wherein the boards have means for interfitment with one another.

3. A game as claimed in claim 1, wherein said code playing pieces are pegs of contrasting colors.

4. A game as claimed in claim 1, wherein said marker elements are contrastingly colored pegs or pins.

5. A game as claimed in claim 1 wherein said code counters are discs contrastingly marked and/or colored.

6. A game as claimed in claim 1 wherein said boards are integral with one another.

7. A game as claimed in claim 1 wherein the individual boards each have an interfitment projection at an upper corner thereof, this projection being recessed to form a pocket for playing pieces.

8. A game as claimed in claim 7 wherein said projection is received between portions of two adjacent other ones of said boards.

9. A game as claimed in claim 7 wherein said recess of said projection also extends into a main portion of the respective board.

* * * * *